US010634285B1

(12) United States Patent
Kelly et al.

(10) Patent No.: US 10,634,285 B1
(45) Date of Patent: Apr. 28, 2020

(54) LIGHT FIXTURE AND RETROFIT KIT FOR DEMANDING HARSH ENVIRONMENTS

(71) Applicant: ABL IP Holding LLC, Atlanta, GA (US)

(72) Inventors: Rick Martin Kelly, Loganville, GA (US); Richard H. S. Bella, Snellville, GA (US); Christopher William Michaelis, Atlanta, GA (US); John Bryan Harvey, Newark, OH (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/211,425

(22) Filed: Dec. 6, 2018

(51) Int. Cl.

| | |
|---|---|
| ***F21K 9/20*** | (2016.01) |
| ***F21V 15/01*** | (2006.01) |
| ***F21K 9/66*** | (2016.01) |
| ***F21V 31/00*** | (2006.01) |
| ***F21V 17/10*** | (2006.01) |
| ***F21V 17/12*** | (2006.01) |
| ***F21V 29/89*** | (2015.01) |
| ***F21K 9/69*** | (2016.01) |
| ***F21V 29/77*** | (2015.01) |
| ***F21V 29/503*** | (2015.01) |
| *F21Y 115/10* | (2016.01) |

(52) U.S. Cl.
CPC ..... *F21K 9/20* (2016.08); *F21K 9/66* (2016.08); *F21K 9/69* (2016.08); *F21V 15/01* (2013.01); *F21V 17/107* (2013.01); *F21V 17/12* (2013.01); *F21V 29/503* (2015.01); *F21V 29/773* (2015.01); *F21V 29/89* (2015.01); *F21V 31/005* (2013.01); *F21Y 2115/10* (2016.08)

(58) Field of Classification Search
CPC .... F21Y 2115/10; F21V 31/00; F21V 31/005; F21K 9/20; F21K 9/23; F21K 9/235
See application file for complete search history.

(56) References Cited

U.S. PATENT DOCUMENTS

| | | | | |
|---|---|---|---|---|
| 6,425,678 | B1 | 7/2002 | Verdes et al. | |
| 7,175,313 | B2 | 2/2007 | Bednara et al. | |
| 7,281,821 | B2 | 10/2007 | Martin et al. | |
| 7,997,761 | B2 | 8/2011 | Peck et al. | |
| 8,545,064 | B2 | 10/2013 | Blincoe et al. | |
| 8,602,599 | B2 | 12/2013 | Zimmer et al. | |
| 10,260,722 | B2 * | 4/2019 | Treible, Jr. | H01Q 19/06 |
| 2017/0307204 | A1 * | 10/2017 | Cattoni | F21S 8/036 |
| 2018/0156437 | A1 * | 6/2018 | Freer | H01Q 19/06 |

(Continued)

OTHER PUBLICATIONS

Catalog pages for "Mercmaster™ LED Low Profile", Appleton Group, Oct. 2017, 4 pages.

(Continued)

*Primary Examiner* — Robert J May
(74) *Attorney, Agent, or Firm* — Kilpatrick Townsend & Stockton LLP

(57) ABSTRACT

A light fixture includes a fixture housing. In some examples, an optic that includes silicone and is at least 5 inches in diameter is coupled to the fixture housing, and the light fixture is compliant with standard UL-844. In various examples, a top cap assembly is coupled to the fixture housing natively or as a retrofit kit. The top cap assembly includes a top cap and an interface ring, and allows for the light fixture to be attached to an existing top cap.

19 Claims, 12 Drawing Sheets

(56) References Cited

U.S. PATENT DOCUMENTS

2019/0080567 A1* 3/2019 Moore ..... G08B 5/36

OTHER PUBLICATIONS

Catalog pages for "Lighting VM2&4LB, VM2&4LC Series, CertiLite. VLED High Wattage—Catalog Logic", Hubble-Killark Lighting, Aug. 14, 2017, 7 pages.
Specification Sheet for "Champ™ LED with top hat adapter", Crouse-Hinds by Eaton, Nov. 1, 2014, 2 pages.
Specification Sheet for "Area Light | Retrofit Options", Dialight, Aug. 8, 2017, 4 pages.

* cited by examiner

LIGHT FIXTURE AND RETROFIT KIT FOR DEMANDING HARSH ENVIRONMENTS

FIELD OF THE INVENTION

This application relates to light fixtures and retrofit kits for light fixtures, and more particularly to light fixtures and retrofit kits for demanding environments.

BACKGROUND

Some light fixtures may be provided in demanding and/or harsh environments, such as those environments for food preparation applications, petroleum refineries, ethanol facilities, chemical plants, power plants, textile mills, water treatment and wastewater treatment facilities, among others. Due to requirements for operating in such environments, light fixtures have traditionally been designed to comply with a standard for one environment, but not necessarily in compliance with the standard for another environment. As such, moving a traditional light fixture from one environment to another often requires significant changes to the light fixture, such as changes to the optics, mountings, etc., which can be costly and time consuming. Installing or changing traditional light fixtures for maintenance or new installations can also potentially damage the electronics of the fixtures because such installations have traditionally relied on fixtures and equipment left in the field that may have degraded. Therefore, there is still a need for a system that can provide for easy installation and/or retrofitting of a light fixture in demanding and/or harsh environments.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain embodiments, a light fixture includes a fixture housing and an optic coupled to the fixture housing. In various aspects, the optic includes silicone and the light fixture is compliant with standard UL-844.

In some embodiments, the light fixture is compliant with standard NSF/ANSI 2-2015. In various embodiments, the light fixture is compliant with standard UL-1598. In certain examples, the optic includes a flange that defines a perimeter edge of the optic, and the optic is coupled to the fixture housing such that the optic forms a seal between the flange of the optic and the fixture housing. In some cases, the light fixture includes a securing ring that secures the optic against the fixture housing.

In various embodiments, the light fixture includes a light source retained on the fixture housing such that the optic covers the light source. In some examples, the light source includes a plurality of light emitting diodes, and the optic is coupled to the fixture housing such that the optic covers the plurality of light emitting diodes.

In certain cases, the fixture housing includes an electronics housing that defines an electronics housing chamber. In various aspects, the light fixture includes a top cap assembly that is hingedly connected to the electronics housing. In some examples, the top cap assembly includes a top cap that selectively engages the electronics housing, and engagement of the top cap with the electronics housing seals the electronics housing chamber. The top cap assembly may also include an interface ring that is configured to engage a fixture support, such as an existing top cap, such that the light fixture is supported on the existing top cap.

According to some embodiments, a retrofit kit for an existing light fixture includes a top cap assembly having a top cap and an interface ring. The top cap defines a first end of the top cap assembly and further defines a top cap chamber having a top wall. In some cases, the top cap is configured to selectively engage an electronics housing of the light fixture and seal an electronics housing chamber of the electronics housing. The interface ring defines a second end of the top cap assembly opposite from the first end. In various aspects, the interface ring is coupled to the top wall outside of the top cap chamber, and the interface ring is configured to engage an existing top cap such that the light fixture is supported on the existing top cap.

In some examples, an orientation of the interface ring relative to the top cap is adjustable such that an orientation of the light fixture relative to the existing top cap is adjustable. In certain embodiments, the top cap includes a top cap gasket, and the interface ring includes an interface ring gasket. In various aspects, the interface ring is a first interface ring that defines a first interface ring diameter, and the retrofit kit includes a second interface ring that is coupled to the first interface ring and defines a second interface ring diameter that is different from the first interface ring diameter.

In some embodiments, the top cap includes a first attachment component and the interface ring includes a second attachment component. In various cases, the retrofit kit is configured to hingedly couple with the electronics housing through the first attachment component, and the retrofit kit is configured to hingedly couple with the existing top cap through the second attachment component. In certain examples, the top cap and interface ring are monolithically formed as an integral unit.

According to various embodiments, a light fixture includes a fixture housing and a top cap assembly. The fixture housing includes an electronics housing that defines an electronics housing chamber. The top cap assembly is coupled to the electronics housing and includes a top cap and an interface ring. The top cap defines a first end of the top cap assembly and selectively engages the electronics housing and seals the electronics housing chamber. The interface ring defines a second end of the top cap assembly opposite from the first end and is configured to engage a existing top cap such that the light fixture is supported on the existing top cap.

In certain embodiments, an orientation of the interface ring relative to the top cap is adjustable such that an orientation of the light fixture relative to the existing top cap is adjustable. In various aspects, the top cap includes a top cap gasket that is configured to form a seal between the top cap and the electronics housing, and the interface ring includes an interface ring gasket that is configured to form a seal with the existing top cap. In some aspects, the top cap includes a first attachment component and the interface ring includes a second attachment component. In various cases, the top cap assembly is hingedly coupled to the electronics housing through the first attachment component, and the top cap assembly is configured to hingedly couple with the existing top cap through the second attachment component.

In some embodiments, the light fixture is compliant with standard UL-1598. In certain aspects, the light fixture includes an optic, and the fixture housing includes a heatsink and a light source retained on the fixture housing. In various embodiments, the light source includes a plurality of light emitting diodes, and the optic is coupled to the fixture housing such that the optic covers the plurality of light emitting diodes. In certain cases, the optic includes silicone, and the light fixture is compliant with at least one of the standard UL-844 or the standard NSF/ANSI 2-2015.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "left," "right," "front," and "back," among others are intended to refer to the orientation as illustrated and described in the figure (or figures) to which the components and directions are referencing.

Embodiments of the present invention are directed to top cap assemblies for light fixtures. Embodiments of the present invention are also directed to optics for light fixtures. The top cap assemblies and/or optics may be provided by either retrofitting them into existing fixtures or providing them on new (i.e., native) fixtures. In certain aspects, the top cap assemblies and/or optics may be provided with the light fixtures that are used in demanding environments and/or in harsh industrial applications. For example, the light fixtures may be used in environments such as those for food preparation applications, petroleum refineries, ethanol facilities, chemical plants, power plants, textile mills, water treatment and wastewater treatment facilities, among others. In some cases, the light fixtures with the top cap assemblies and/or optics comply with certain standards for such demanding and/or harsh environments.

Embodiments of the present invention are directed to various ways by which to incorporate top cap assemblies and/or optics with light emitting diode (LED) light fixtures, but it will be recognized that the invention may be embodied in light fixtures using other kinds of light sources, for example fluorescent, incandescent, or other kinds of light sources.

Light Fixture

Figure 1:
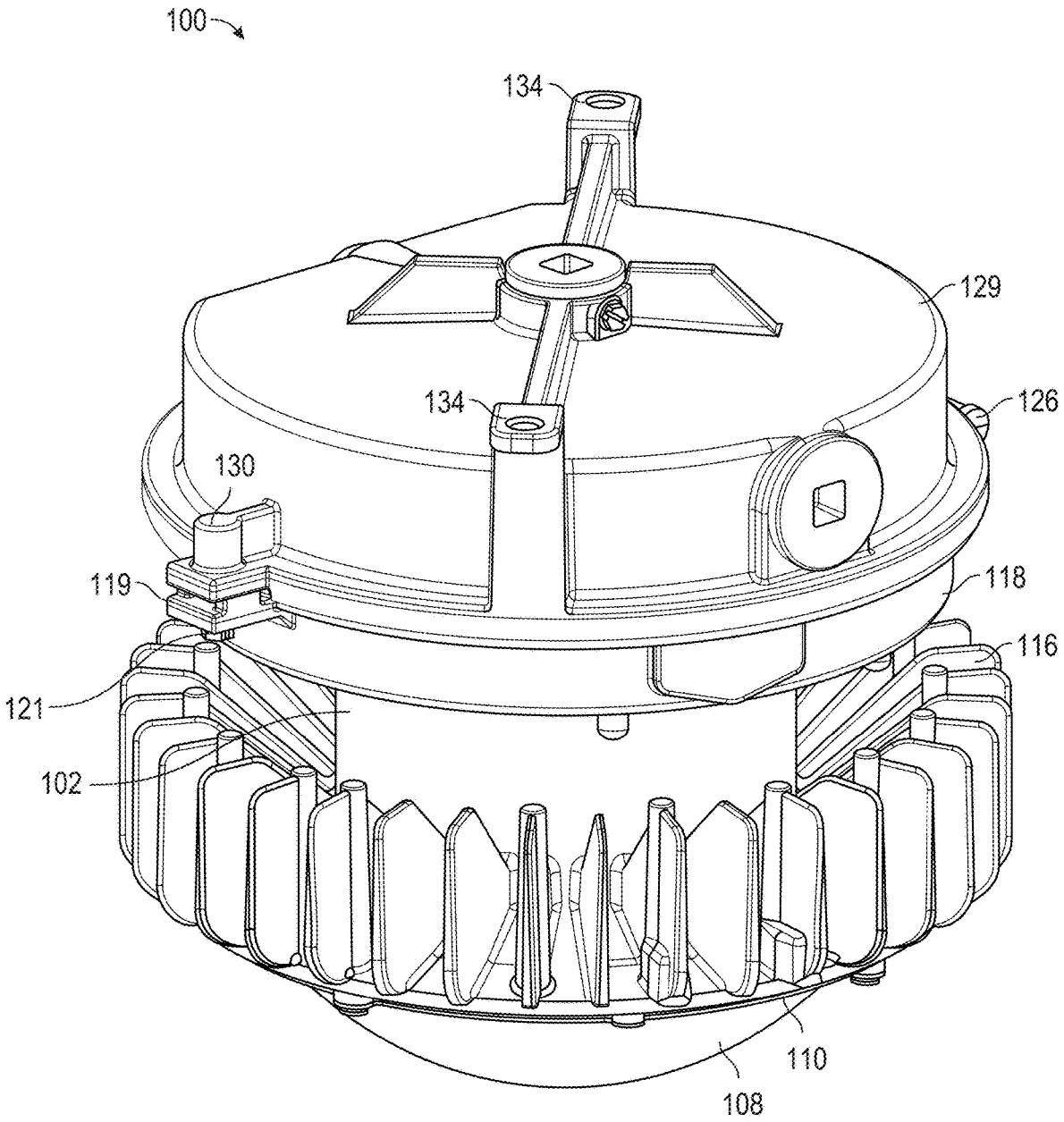
FIG. 1 is a top perspective view of a light fixture according to aspects of the current disclosure.
Figure 2:
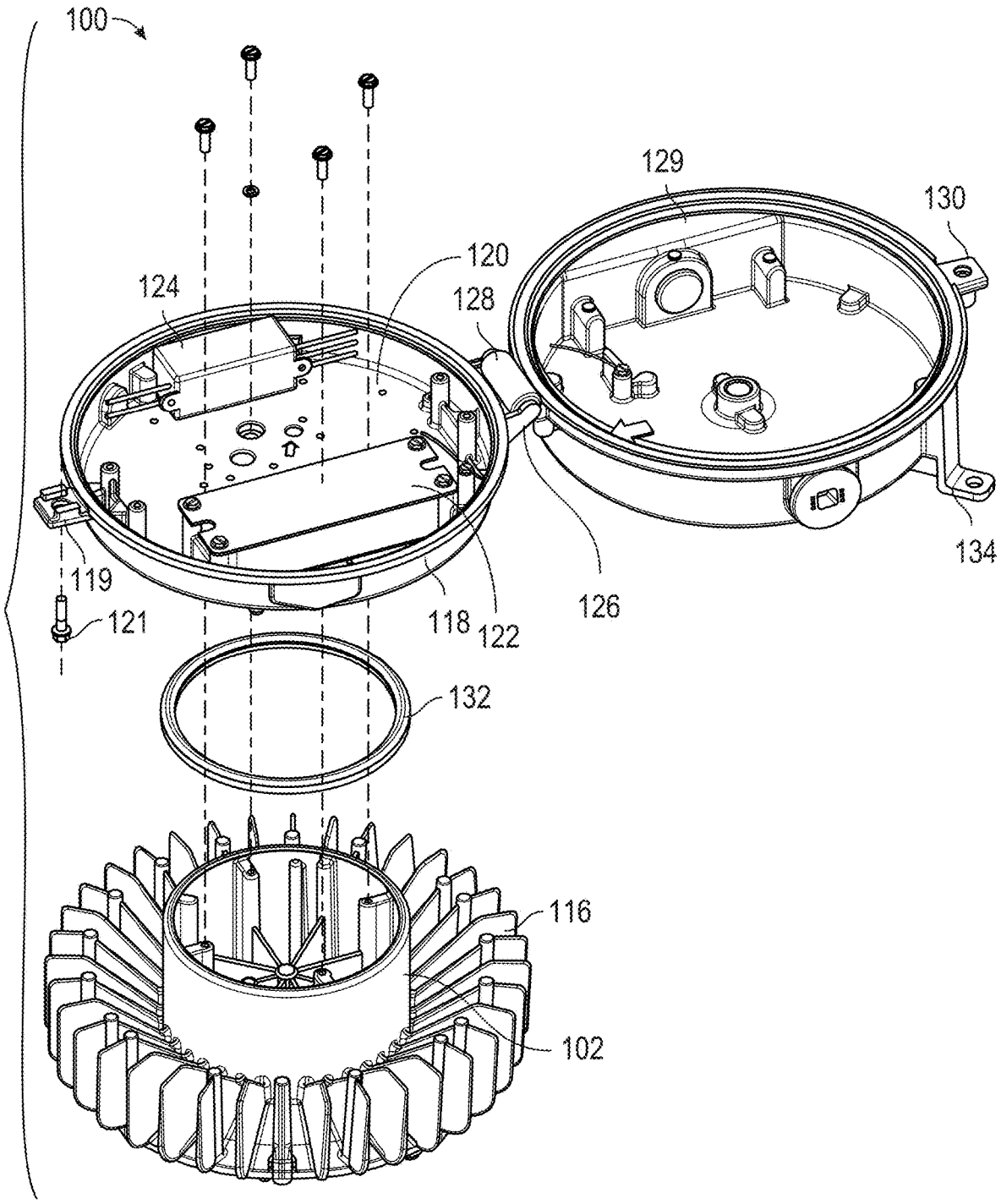
FIG. 2 is an exploded assembly view of the light fixture of FIG. 1.
Figure 3:
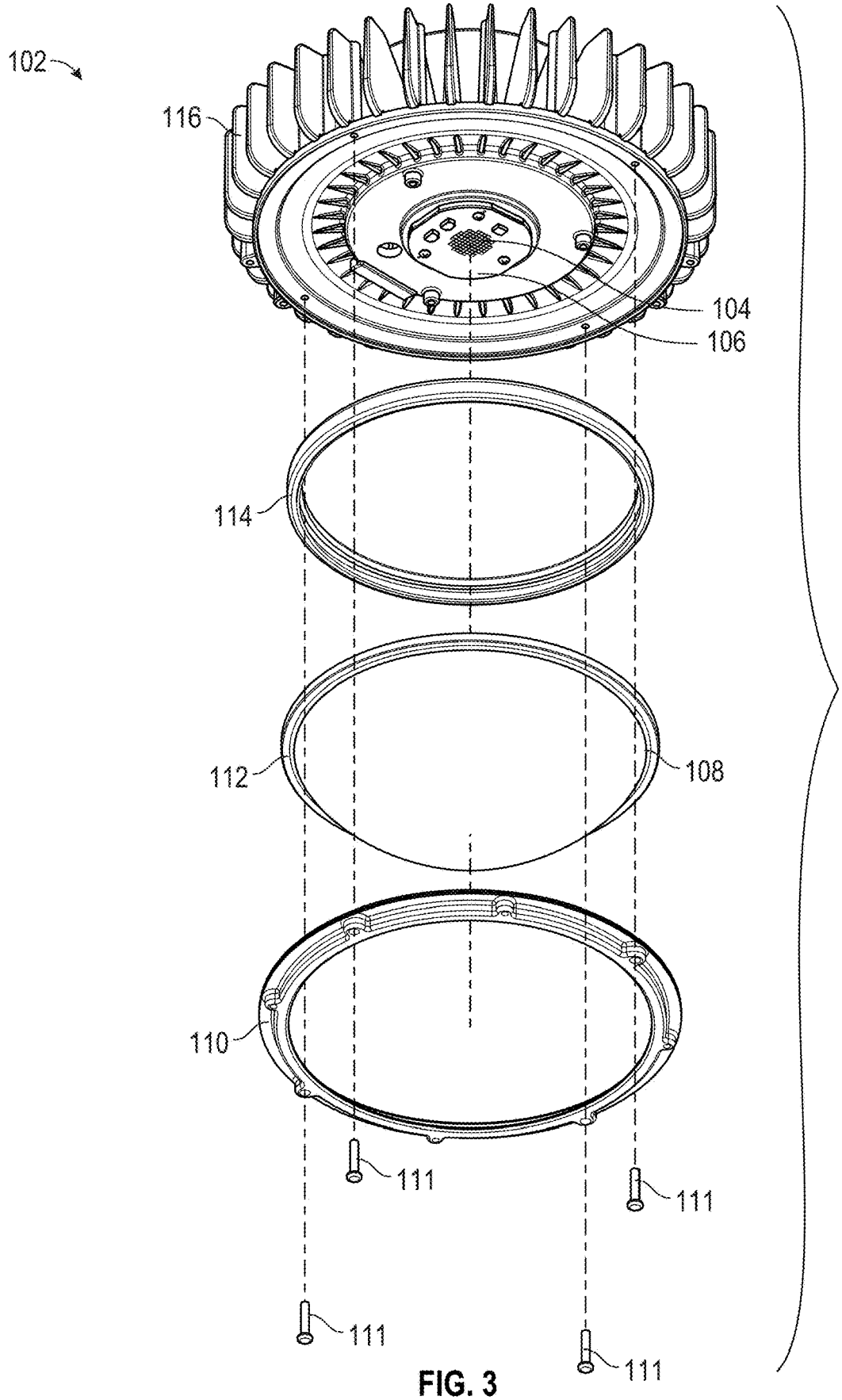
FIG. 3 is an exploded assembly view of the housing of the light fixture of FIG. 1.

FIGS. 1-3 illustrate an example of a light fixture 100. The light fixture 100 generally includes a fixture housing 102 with a light source, which may be LEDs 104 (see FIG. 3) or other suitable light sources. The side of the housing 102 with the LEDs 104 is the light emitting side of the light fixture 100, and the side opposed from the LEDs 104 is the non-light emitting side of the fixture 100 (because light is not directed toward that region of the light fixture). The light fixture may be mounted in or on a ceiling or other suitable structure with the light emitting side facing downward into the space below, but this is not a requirement, and the light fixture 100 may be usable in any orientation.

The LEDs 104 are mounted on the housing so as to emit light from the light-emitting side of the light fixture 100. In some examples, the LEDs 104 are mounted on a printed circuit board 106 (PCB). In this example, the light fixture 100 includes one PCB 106 having LEDs 104. However, in other embodiments no PCB 106 is needed; rather, the LEDs 104 are chip-on-board LEDs provided directly on the housing 102 or other suitable location on the fixture 100. In further examples, any number of PCBs 106 may be provided, such as one PCB 106, two PCBs 106, or more than two PCBs 106. The LEDs 104 may be various types of LEDs including single-die LEDs, multi-die LEDs, direct current (DC) LEDs, alternating current (AC) LEDs, organic light emitting diodes, and/or various other suitable LEDs. White, color, or multicolor LEDs may be used. Moreover, the LEDs 104 need not all be the same color and/or type; rather, mixtures of different colors and/or types of LEDs may be used.

As illustrated in FIGS. 1 and 2, the light fixture 100 includes an optic 108 (such as a lens, diffuser, or other suitable optic) provided over the LEDs 104 and positioned on the housing 102. The optic 108 may be constructed from glass, acrylic, polycarbonate, and/or various other suitable materials as discussed below. In certain cases, and as discussed below, the type of material used for the optic 108 may be limited by the particular environment in which the light fixture 100 is to be installed. In various examples, the optic 108 may be positioned on the housing 102 through various suitable mechanisms such as via snap-fitting onto the housing, nuts and bolts, pins, etc. In the example of FIGS. 1-3, the optic 108 is positioned on the housing 102 through a retaining ring 110. In this example, the optic 108 includes a flange 112, and the retaining ring 110 captures the flange 112 such that, when assembled, the flange 112 is retained between the retaining ring 110 and the housing 102 with screws 111.

In certain cases, a gasket 114 is provided between the flange 112 and the housing 102 to form a seal. In some cases, the gasket 114 is wrapped around the flange 112 (in addition to being positioned between the flange 112 and the housing 102), although it need not be in other examples. Regardless, the gasket 114 creates a seal between the flange 112 and the housing 102 that helps prevent dirt, moisture, dust, etc. from entering the portion of the fixture covered by the optic 108, and may further allow for the light fixture 100 to comply with certain standards for particular applications as discussed in detail below.

In various examples, the housing 102 optionally includes a heat sink 116, although in other examples, the heat sink 116 may be excluded. The heat sink 116 may include a plurality of fins, although in other examples, various other suitable types and/or configurations of a heat sink may be utilized. In some cases, the housing 102 and heat sink 116 are integrally or monolithically formed as a unitary component. In other examples, the heat sink 116 may be a separate component that is coupled to the housing 102 through various suitable fasteners including, but not limited to, screws, bolts, rivets or other mechanical or chemical fasteners, combinations thereof, or various other suitable fasteners. The housing 102 and/or heat sink 116 may be formed from die cast aluminum in some cases, although various other suitable materials for the housing 102 and/or heat sink 116 may be utilized. It will be appreciated that the material for the housing 102 does not necessarily have to be the same as the material for the heat sink 116.

As best illustrated in FIGS. 1 and 2, the light fixture 100 includes an electronics housing 118. Optionally a gasket 132 is provided between the housing 102 and the electronics housing 118, although it may be omitted in other examples. Although the housing 102 and electronics housing 118 are illustrated as separate components in FIGS. 1-3, in other examples, the housing 102 and electronics housing 118 may be formed as a unitary or monolithic component.

The electronics housing 118 defines an electronics housing chamber 120, and various components of the light fixture 100, particularly electronic components, may be retained within the electronics housing 118. For example, a driver 122, wireless module 124 for wireless communication, and/or various other components may be retained with in the electronics housing 118. In certain examples, the electronics housing 118 includes an attachment component 126 for a top cap 129. In some examples, the attachment component 126 is a rod or pin, and the top cap 129 includes a corresponding attachment component 128 such as a clip or projection that engages with the attachment component 126. Various other suitable types of attachment components or mechanisms may be used such that the top cap 129 can be attached to the electronics housing 118. In certain cases, the top cap 129 is movable (via attachment components 126, 128) from an open position (see FIG. 2) to a closed position (see FIG. 1) relative to the electronics housing 118 (and vice versa), although it need not be in other examples. In various examples, the electronics housing 118 and top cap 129 each includes a locking feature 119, 130 that engage each other (such as via screw 121) to lock the top cap 129 in a closed position relative to the electronics housing 118. The locking features 119, 130 may be various suitable interlocking mechanisms or devices for locking in the top cap 129 in a closed position including, but not limited to, hooks, pins, clips, snaps, clasps, screws, bolts, rivets, hook and loop fasteners, combinations thereof, or various other suitable devices.

In certain examples, the top cap 129 is movable relative to the electronics housing 118 such that the top cap 129 can selectively provide or prevent access to the electronics housing chamber 120. In various examples, when the top cap 129 is engaged with the electronics housing 118, a seal is formed between the top cap 129 and the electronics housing 118 such that the electronics housing chamber 120 is sealed. Optionally, a gasket (not shown) is provided between the top cap 129 and the electronics housing 118 to facilitate the sealing of the electronics housing chamber 120, although it need not be in other examples. As described below, the sealing of the electronics housing chamber 120 may prevent dirt, moisture, dust, etc. from entering the electronics housing chamber 120, and may further allow for the light fixture 100 to comply with certain standards for particular applications. In various aspects, the top cap 129 includes one or more mounting features 134 that allow for the light fixture 100 to be mounted or otherwise installed as desired, such as on a ceiling, on a mounting bracket, on a support post, etc. For example, the mounting features 134 may allow for a yoke mount, a side arm mount, a hook or loop mount, etc.

In various examples, the light fixture 100 is compliant with one or more standards such that the light fixture 100 is suitable for use in harsh industrial applications including, but not limited to, food preparation, petroleum refineries, ethanol facilities, chemical plants, power plants, textile mills, water treatment and wastewater treatment facilities. As one example, the light fixture 100 may be compliant with standards for food preparation applications. In these applications, the optic 108 may not be glass (due to debris and/or shattering issues), and the optic 108 may instead be other materials such as acrylic or polycarbonate. As another example, the light fixture may be compliant with standards for other harsh or hazardous locations. In such examples, the optic 108 may not be allowed to be glass. In some cases, the light fixture 100 is compliant with the UL standard UL-844 titled "UL Standard for Safety Luminaires for use in Hazardous (Classified) Locations." in various cases, the light fixture 100 is compliant with the UL standard UL-1598 titled "UL Standard for Safety Luminaires." in certain cases, the light fixture 100 is compliant with the National Sanitation Foundation (NSF)/National Standards Institute (ANSI) standard NSF/ANSI 2-2015 titled "Food Equipment."

Silicone Optic

Figure 4:
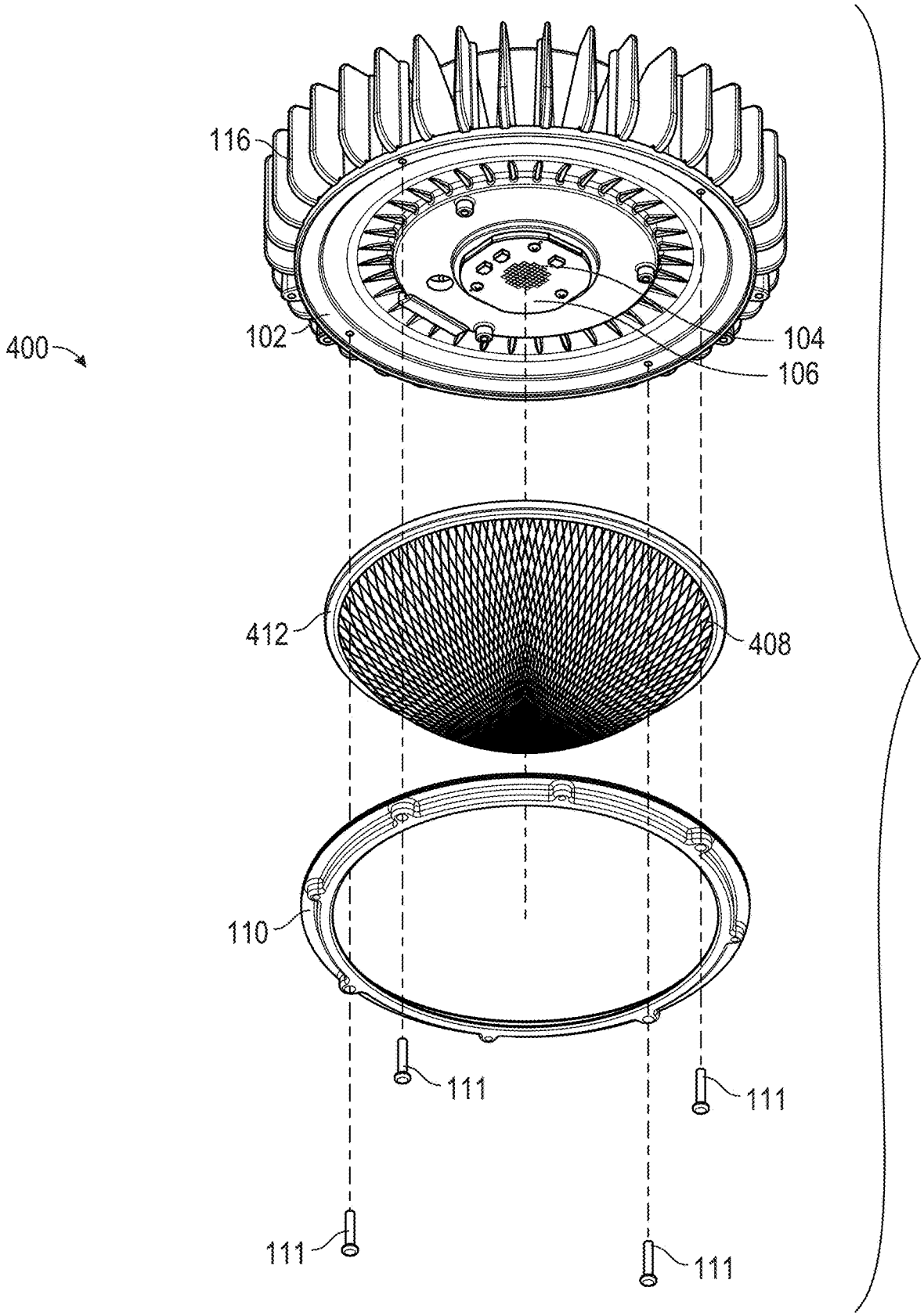
FIG. 4 is an exploded assembly view of a light fixture with a silicone optic according to aspects of the current disclosure.
Figure 5:
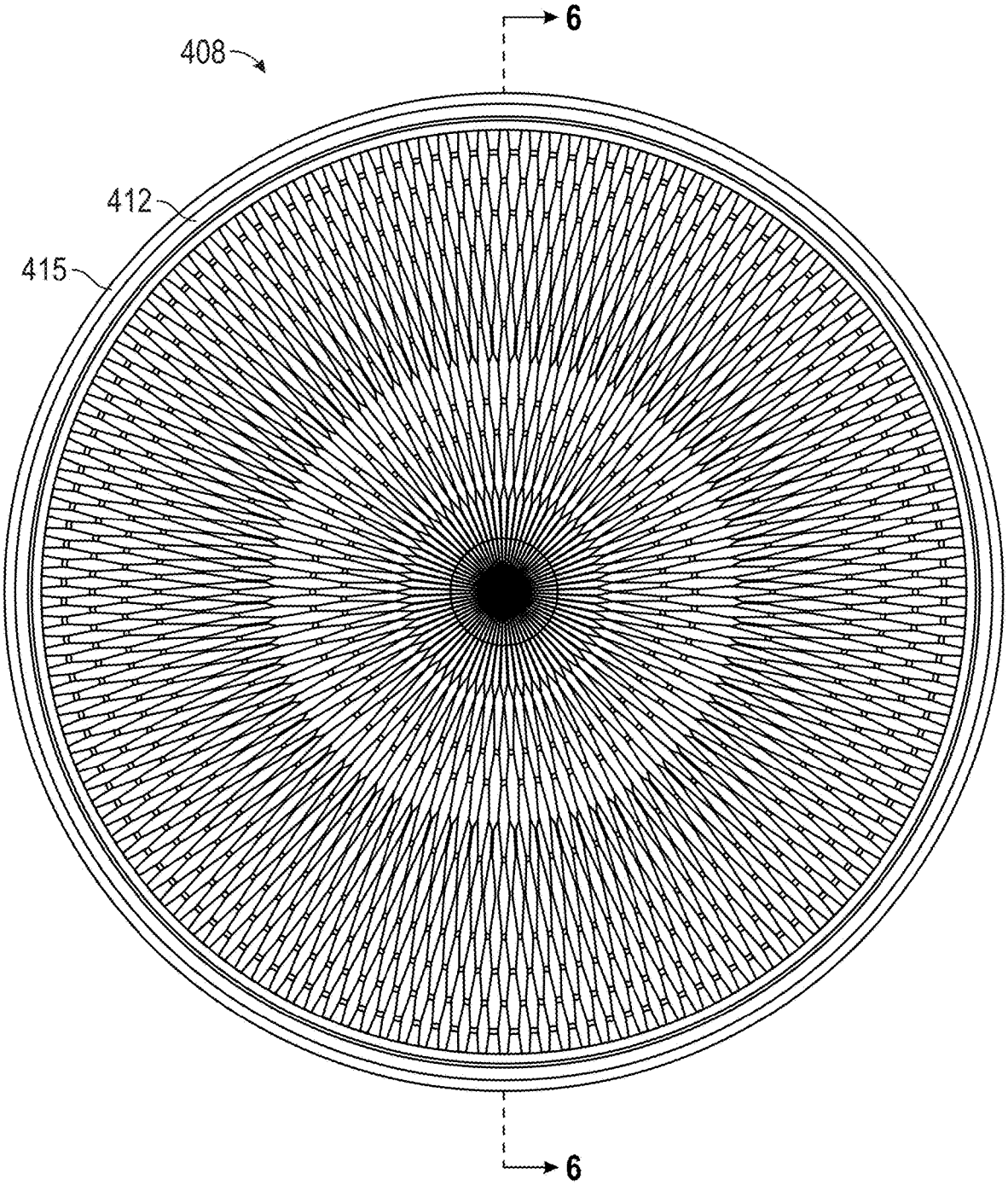
FIG. 5 is a bottom plan view of the silicone optic of FIG. 4.
Figure 6:
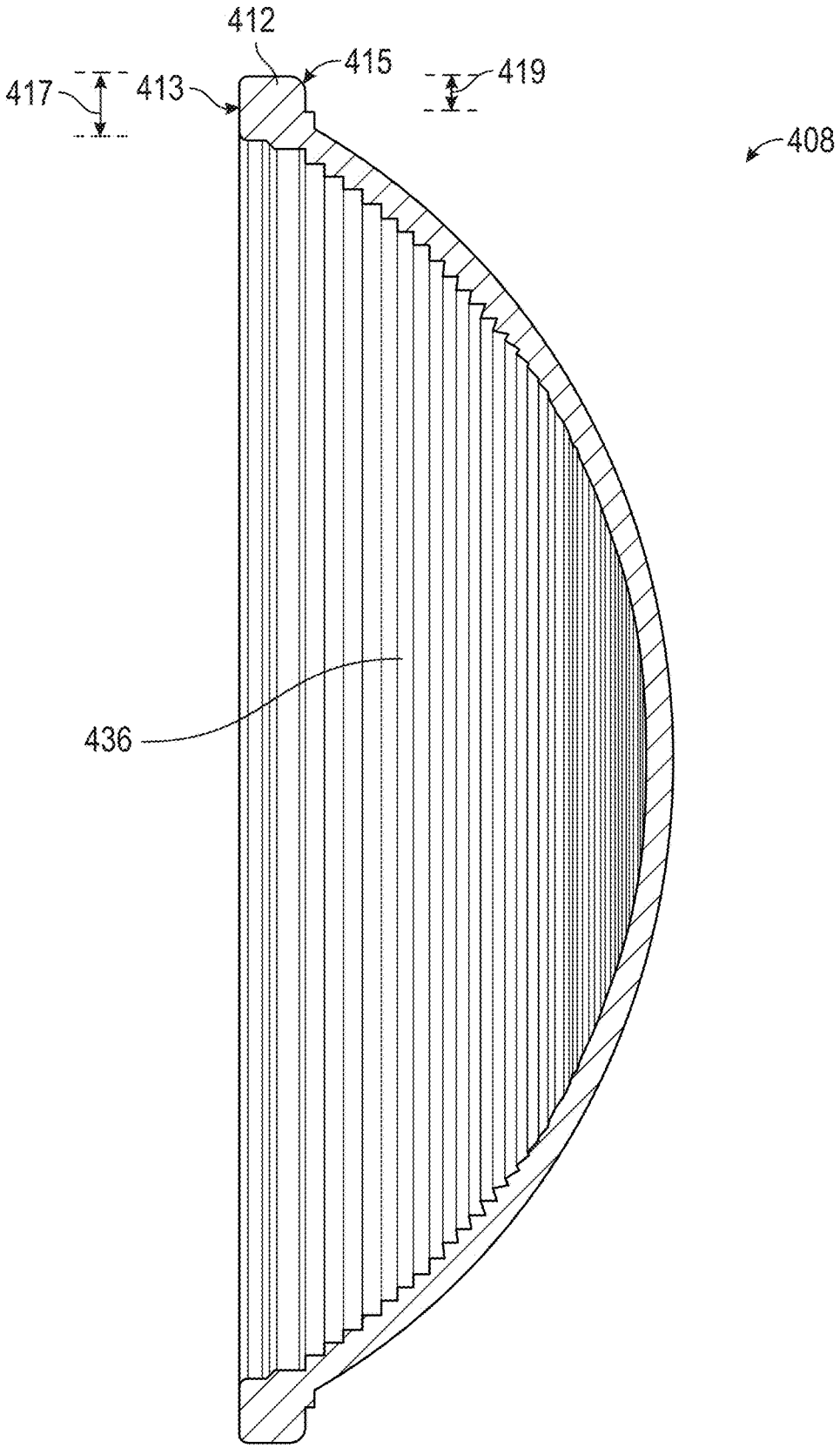
FIG. 6 is a sectional view of the silicone optic taken along line 6-6 in FIG. 5.
Figure 7:
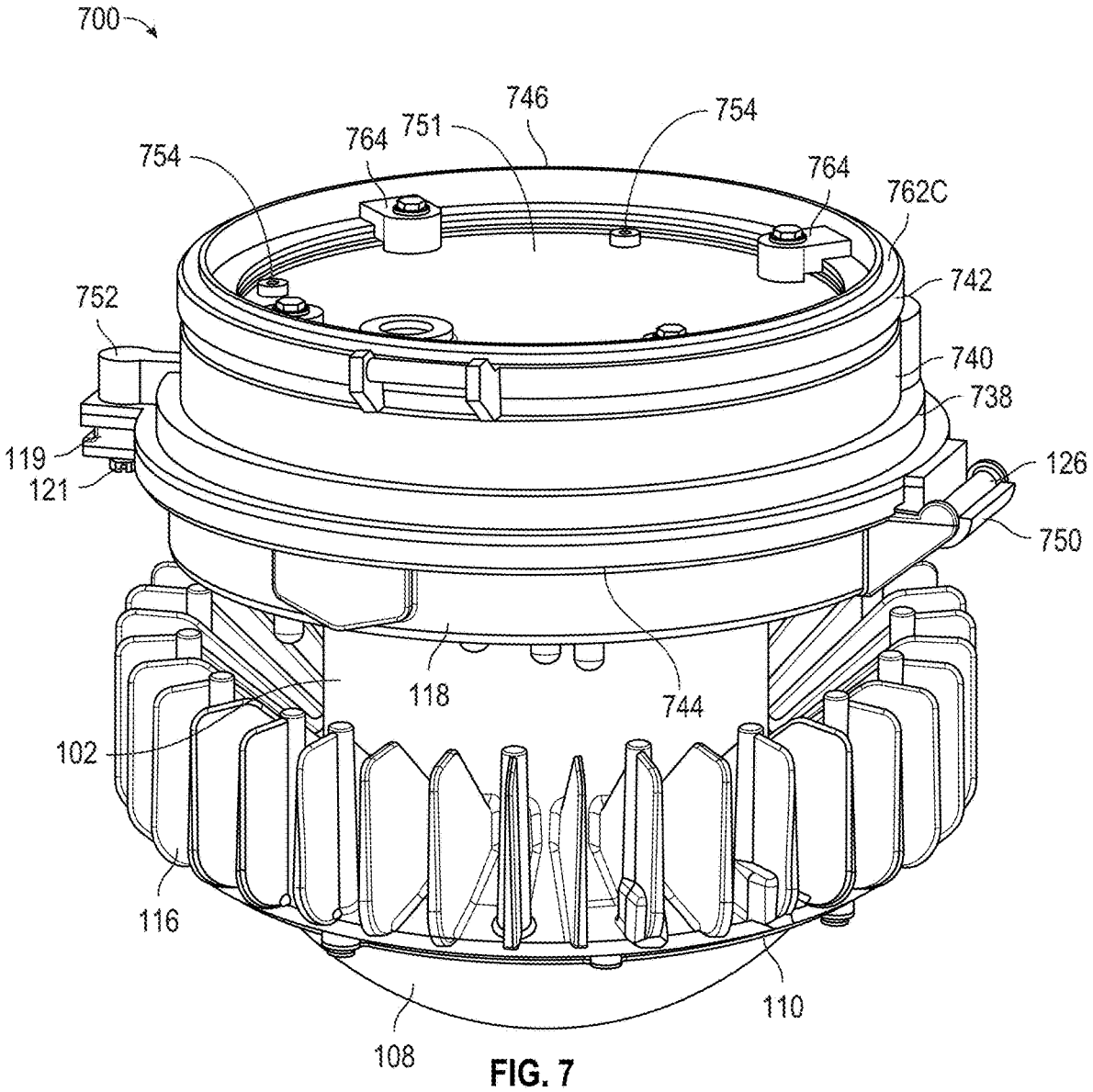
FIG. 7 is a top perspective view of a light fixture with a retrofit top cap according to aspects of the current disclosure.
Figure 8:
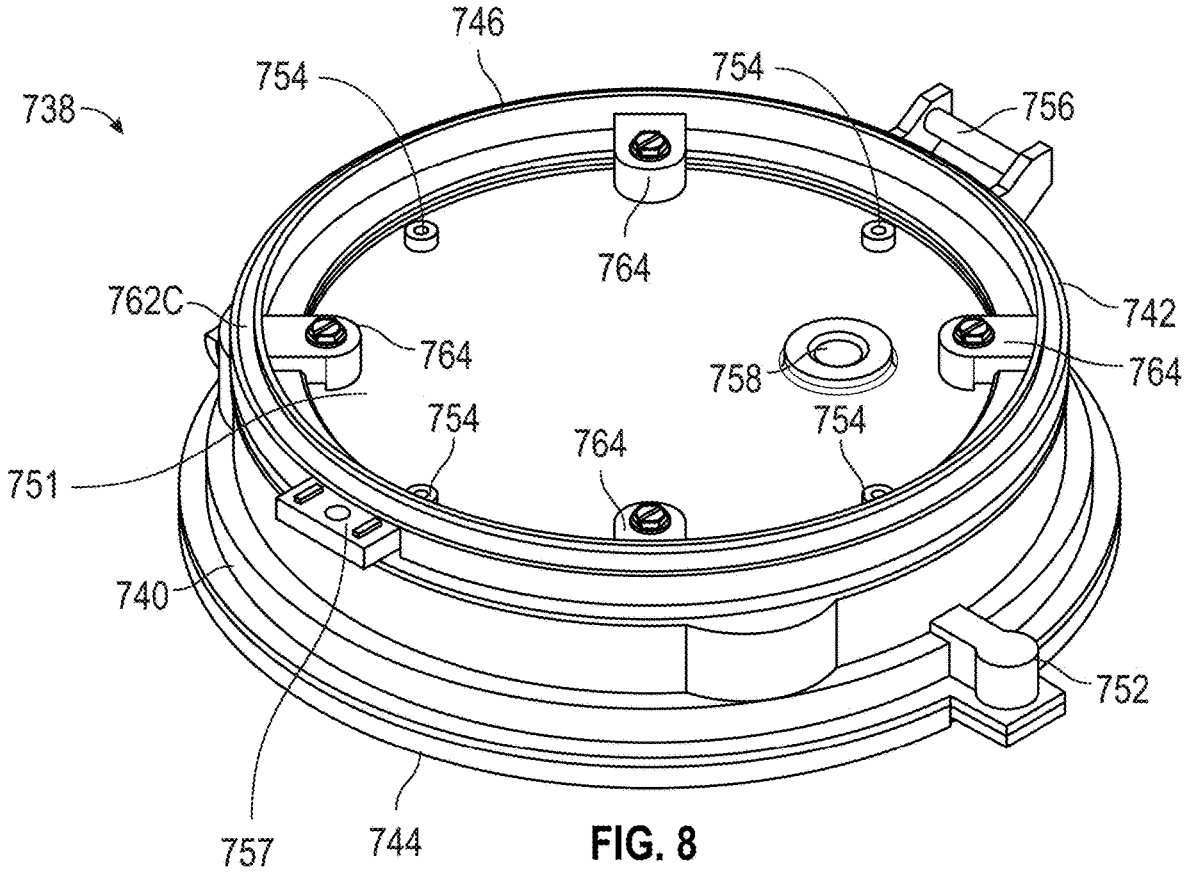
FIG. 8 is a top perspective view of the retrofit top cap of FIG. 7.
Figure 9:
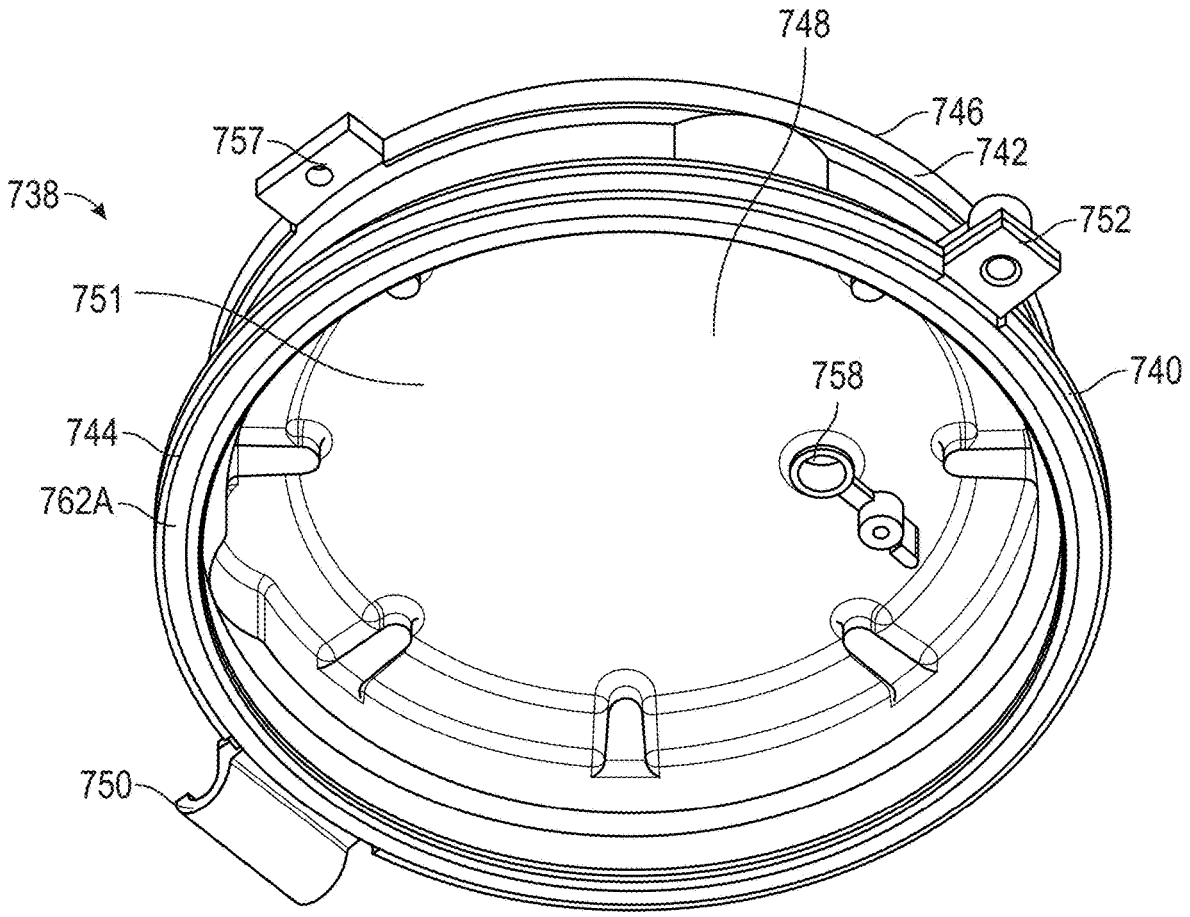
FIG. 9 is a bottom perspective view of the retrofit top cap of FIG. 7.

Embodiments of the present invention relates to an improved optic for light fixtures, such as (but not limited to) those shown in FIGS. 1-3 or the light fixture 400 shown in FIG. 4. The light fixture 400 is substantially similar to the light fixture 100 except for the optic. Referring to FIGS. 4-6, in various examples, a silicone optic 408 is included with the light fixture 400. Various types of silicone materials may be used to form the silicone optic 408. In some examples, the silicone used is compliant with at least one UL-844, UL-1598, and/or NSF/ANSI 2-2015. For example, in some cases, the silicone material may be Silopren 7180 moldable silicone from Momentive. In other cases, the silicone material may be MS-4022 moldable silicone from Dow Corning. Other sources or types of silicone may be used as desired. While the silicone optic 408 is shown having a substantially semi-hemispherical shape, it could assume any geometrical shape. Moreover, the silicone optic 408 may be of any type (clear, diffuse, prismatic, etc.) that achieves the desired light emission from the fixture. The silicone optic 408 may have any geometry and may be provided with any surface enhancements or no surface enhancements.

As illustrated in FIG. 4, in various examples, the silicone optic 408 is coupled to the housing 102 such that the silicone optic 408 covers the LEDs 104 (or other light source). In various examples, the silicone optic 408 includes a flange 412. In some cases, the silicone optic 408 is coupled to the housing 102 by securing the retaining ring 110 to the housing 102 such that the flange 412 is captured between the retaining ring 110 and the housing 102. In other examples, the optic 408 may be coupled to the housing 102 through various other suitable devices or mechanisms. In some cases, the silicone optic 408 may have a diameter of about 9.3 inches, although in other examples, the silicone optic 408 may be various suitable diameters as desired. As one non-limiting example, in various aspects, the silicone optic 408 may have a diameter of from about 5 inches to about 20 inches, such as from about 7 inches to about 17 inches, such as from about 8 inches to about 14 inches, such as from about 9 inches to about 11 inches. In certain examples, the silicone optic 408 has a diameter of at least 5 inches. However, in other examples, the diameter may be less than 9 inches (or less than 5 inches) and/or greater than 11 inches (or greater than 20 inches).

The flange 412 generally includes an inner surface 413 and an outer surface 415. The inner surface 413 has a width 417 and is configured to engage with the housing 102 when assembled. In some cases, the width 417 is at least a minimum width of the inner surface 413 needed to create a sealing contact with the housing 102 such that an optic chamber 436 is sealed and/or the light fixture 400 complies with various standards discussed below. As best illustrated in FIG. 6, the outer surface 415 may extend a predetermined distance 419 outward from the optic 408. In various aspects, the predetermined distance 419 corresponds to at least a minimum amount of the flange 412 that is needed to engage with the retaining ring 110. In the example of FIGS. 4-6, the flange 412 has a generally rectangular geometry. However, in other examples, the flange 412, including the inner surface 413 and/or the outer surface 415, could assume any geometrical shape as desired and/or sufficient for creating the sealing contact with the housing 102.

In certain examples, the light fixture 400 is devoid of the gasket 114 of the light fixture 100 shown in FIGS. 1-3. Rather, the silicone optic 408 itself forms a seal with the housing 102 when the silicone optic 408 is coupled to the housing 102 such that the LEDs 104 (or other light source) are sealed within an optic chamber 436. In other words, the silicone optic 408 is self-sealing, and an additional or separate gasket or other sealing device is not needed to form the seal between the optic and the housing.

In addition to being self-sealing, the silicone optic 408 may provide further advantages over optics made from other materials because the silicone optic is impact resistant (i.e., does not shatter under force) and is chemically stable and resists degradation and discoloration over time. Molding of the silicone optic 408 from a liquid silicone may also improve the optical clarity compared to optics made from other materials (e.g., glass) such that light emitted from the optic is sharper and less distorted. The silicone optic 408 may contribute to the light fixture's compliancy with a plurality of standards for harsh industrial applications, and the light fixture can be installed in such environments without having to change the optic (as would be the case with optics having other materials). As one non-limiting example, the silicone optic 408 may render the light fixture compliant with one or more of the standards UL-844 (for hazardous locations) published Jun. 29, 2012, UL-11598 (for safety luminaires) published Aug. 28, 2018, and/or NSF/ANSI 2-2015 (for food preparation applications) published Dec. 11, 2015, among other standards. By comparison, for a light fixture without the silicone optic 408, food preparation environments having the NSF/ANSI 2-2015 standard generally do not allow for glass optics due to debris and shattering issues, but plastic optics, such as acrylic and polycarbonate, are brittle and degrade quickly and discolor with age. On the other hand, hazardous location requirements having the UL-844 and/or UL-1598 standard do not allow for plastic optics. In this example, the optic must be switched out to comply with the various standards, but even then, the plastic or glass optics may provide limited durability and useful life.

Top Cap Assembly

Another example of a light fixture 700 is illustrated in FIGS. 7-10. The light fixture 700 is substantially similar to the light fixture 100 except that the light fixture 700 includes a top cap assembly 738. The light fixture 700 may include either the optic 108 or the optic 408 described above (i.e., it can but does not have to be made of silicone).

Traditionally, if a light fixture included a top cap (such as the top cap 129), to replace the light fixture, the housing of the light fixture is decoupled from the top cap, and the top cap is left installed in the field. Because a variety of styles of top caps with various diameters, other dimensions, mounting styles, etc. exist, light fixtures have traditionally been compatible with only a certain type of top cap, and there has been no way to install different light fixture types on different top caps. Moreover, installing light fixtures has traditionally relied on the gaskets or other sealing devices left on the top cap in the field. As such, the ability to change or install new light fixtures has traditionally been very limited.

In view of the limitations of existing light fixtures, the top cap assembly 738 provides an interface between a new or different light fixture 700 and a top cap, such as the top cap 129 or existing top caps that may be left in the field, such that a new or different light fixture 700 can be installed in an environment without having to replace the top cap. As used in this section, an "existing" top cap refers to a top cap that could be left in the field or otherwise provided separately from the top cap assembly 738, such as the top cap assemblies 738, 1138, and 1238 according to the present disclosure or other types of top caps. As described in detail below, the top cap assembly 738 is provided between the housing 102 of the new light fixture 700 and the existing top cap. In certain cases, a top cap 740 of the top cap assembly 738 is coupled with the electronics housing 118, and an interface ring 742 of the top cap assembly 738 is configured to couple with the existing top cap. In various aspects, the interface ring 742 is adjustable relative to the top cap 740 such that the top cap assembly 738 can provide an interface with various sizes and types of existing top caps, such as existing top caps having different diameters, different shapes, different mounting mechanisms, etc.

Figure 10:
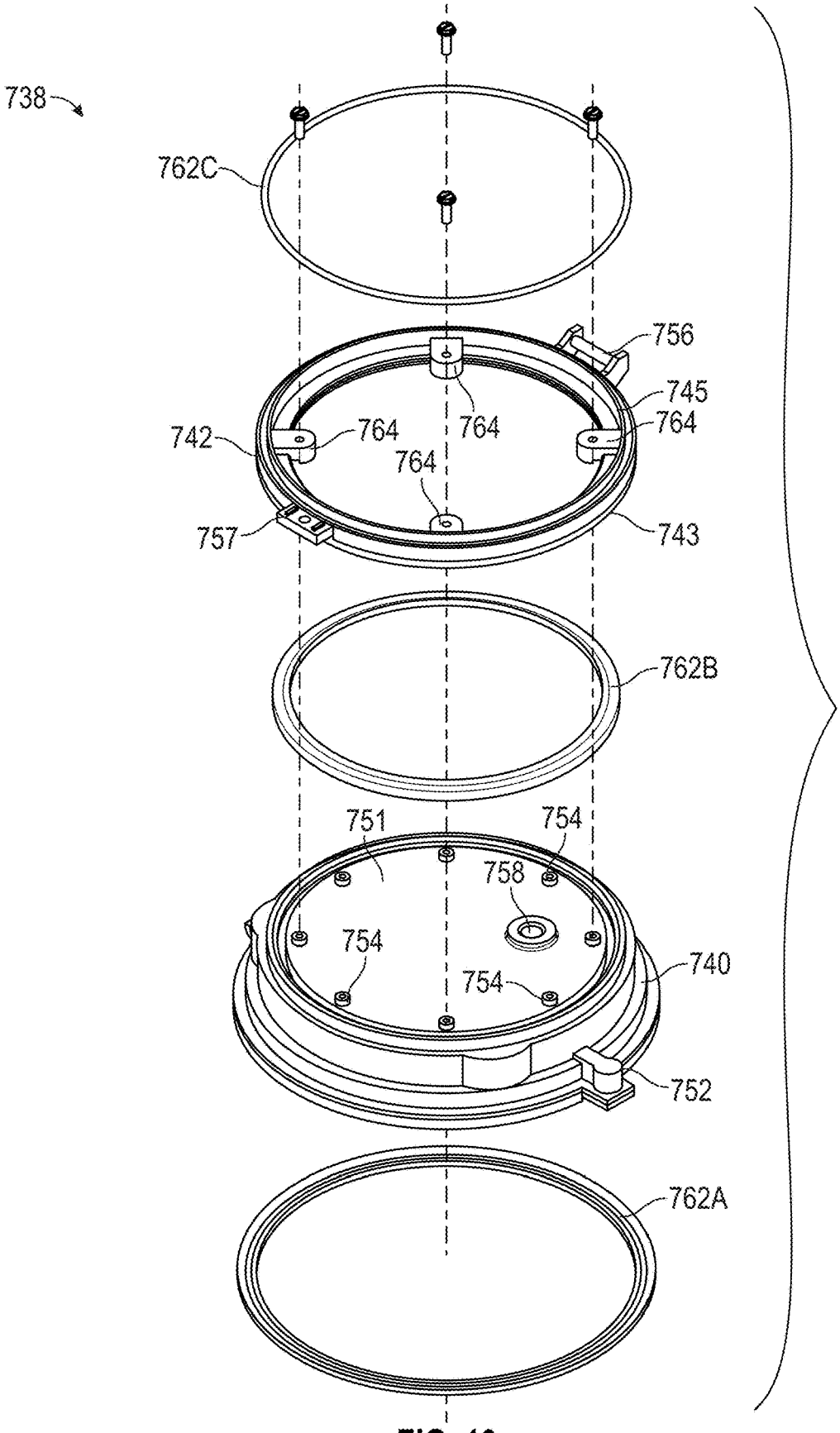
FIG. 10 is an exploded assembly view of the retrofit top cap of FIG. 7.

As best seen in FIG. 10, the top cap assembly 738 includes the top cap 740 and the interface ring 742. In various examples, the top cap 740 defines a first end 744 of the top cap assembly 738 and the interface ring 742 defines a second end 746 of the top cap assembly 738. In various examples, the top cap assembly 738 may be provided with the light fixture 700 by either retrofitting it into an existing fixture or providing it on a new (i.e., native) fixture. Accordingly, in some examples, the top cap assembly 738 may be a retrofit kit.

The top cap 740 defines a top cap chamber 748 that has an top wall 751. In various examples, the top cap 740 includes an attachment component 750 that is configured to engage with the attachment component 126 of the electronics housing 118. In the example of FIGS. 7-10, the attachment component 126 is a rod and the attachment component 750 is a hook, but in other examples, the attachment components 126 and 750 may be various suitable attachment devices or mechanisms that allow for the top cap assembly 738 to be movable relative to the electronics housing 118. In some cases, similar to the top cap 129, the top cap 740 may include a locking feature 752 that engages locking feature 119 on electronics housing 118 to secure the top cap 740 in a closed position. In various examples, the top wall 751 defines a wiring aperture 758 that provides access for various wires to the top cap chamber 748 through the top wall 751.

As best illustrated in FIG. 10, the interface ring 742 includes a first end 743 and a second end 745 opposite from the first end 743. In various examples, the second end 745 is the second end 746 of the top cap assembly 738. When the top cap assembly 738 is assembled, the first end 743 of the interface ring 742 is adjacent to the top wall 751 of the top cap 740. In some cases, a diameter of the first end 743 may correspond with a diameter of the top wall 751, although it need not in other examples. In various aspects, a diameter of the second end 745 may correspond with a diameter of the existing top cap, and as such, may be the same as or different from the diameter of the first end 743. In some examples, a diameter of the first end 743 is the same as a diameter of the second end 745, although it need not be in other examples. For example, in some cases, the diameter of the second end 745 is less than the diameter of the first end 743 or greater than the diameter of the first end 743. As another example, FIGS. 11 and 12 each illustrate an example of another top cap assembly where the diameter of the second end 745 is greater than the diameter of the first end 743.

The interface ring 742 also includes an attachment component 756. The attachment component 756 provides an attachment location for the light fixture 700 such that the light fixture 700 can be installed or supported on various types of existing top caps. In certain examples, the attachment component 756 is configured to engage with the attachment component 128 of the existing top cap. As such, the attachment component 756 can be various suitable joining or coupling mechanisms that are complimentary to the attachment component 128 of the existing top cap while allowing for selective movement of the top cap assembly 738 (and optionally light fixture 700) relative to the existing top cap. In some cases, the attachment component 756 is similar to the attachment component 126, although it need not be in other examples. In the example of FIGS. 7-10, the attachment component 756 includes a rod.

In various examples, the interface ring 742 also includes a locking feature 757 that is configured to engage with the locking feature 130 of the existing top cap. The locking feature 757 can be various suitable locking mechanisms that are complimentary to the locking feature 130 such that the existing top cap can selectively be locked in a closed position relative to the interface ring 742.

In some examples, the interface ring 742 is monolithically or integrally formed with the top cap 740 such that the top cap assembly 738 is a unitary component. In other examples, as illustrated in FIGS. 7-10, the interface ring 742 is a separate component coupled to the top cap 740 through various suitable permanent or non-permanent joining mechanisms. In various examples, the interface ring 742 is coupled adjacent the top wall 751.

In certain cases, the interface ring 742 is coupled to the top cap 740 such that a position of the attachment component 756 is maintained relative to the top cap 740. In other examples, and as illustrated in FIGS. 7-10, an orientation of the interface ring 742 relative to the top cap 740 is adjustable such that the position of the attachment component 756 relative to the top cap 740 can be adjusted. In some cases, the top wall 751 defines a plurality of mounting locations 754 that the interface ring 742 can selectively attach to in order to orient the attachment component 756 relative to the top cap 740. In the example of FIGS. 7-10, the top wall 751 includes eight mounting locations 754 (best illustrated in FIG. 10), and the interface ring 742 includes four mounting tabs 764 that selectively attach to the mounting locations 754 with bolts. However, the number and/or location of mounting locations 754 and/or mounting tabs 764 should not be considered limiting on the current disclosure.

Moreover, in other examples, various other suitable mechanisms or devices may be utilized such that the orientation of the interface ring 742 relative to the top cap 740 can be adjusted, and the disclosure of the mounting locations 754 and/or mounting tabs 764 should not be considered limiting on the current disclosure. As some non-limiting examples, in other cases, the interface ring 742 may be joined to the top cap 740 through a freely-rotating ring that swivels through a track built into the top cap 740, multiple hinges and bolt mounts may be provided on the interface ring 742 for each orientation, or modular hinge and bolt mounts may be attached as needed to features around the outside of the ring. In various cases, the adjustability of the interface ring 742 relative to the top cap 740 may allow for orientation of the LEDs 104 (or other light source) relative to the existing top cap to which the interface ring 742 is coupled. As one non-limiting example, the adjustability of the interface ring 742 may allow for an orientation that provides asymmetric optical distribution from the light fixture 700 in the same direction as another fixture in the field.

In certain cases, depending on the diameter or structure of the existing top cap, the interface ring 742 can be controlled such that the second end 745 is sized to sufficiently engage the existing top cap and the first end 743 is sized to sufficiently engage with the top cap 740. In some cases, the interface ring 742 is controlled by changing the interface ring 742 that is coupled with the top cap 740. As one non-limiting example, an interface ring 742 where the first end 743 and the second end 745 have the same diameter may be decoupled from the top cap, and another interface ring 742 with a second end 745 having a diameter that is greater than the diameter of the first end 743 (and sufficient to mate with the top cap) may be installed.

In other examples, the interface ring 742 is a universal interface ring that is optionally adjustable. As a non-limiting example, the interface ring 742 may include extensions or other suitable components, the interface ring may include a plurality of nesting sub-rings, or the ring itself can change its shape, to selectively control the diameter of the first end 743 and/or the diameter of the second end 745.

In various examples, the diameter of the end of the top cap assembly 738 that engages with the existing top cap may be controlled by providing a plurality of interface rings with varying diameters as needed. As one example, the interface ring 742 is a first interface ring, and the top cap assembly 738 is controlled by successively attaching a second interface ring with a second end 745 having a diameter that is greater than the diameter of the first end 743 that can be coupled to an existing top cap having a larger diameter. Alternatively, a second interface ring with a second end 745 having a diameter that is less than the diameter of the first end 743 may be coupled to the first interface ring such that the top cap assembly 738 can be coupled to an existing top cap having a smaller diameter. Various other combinations of interface rings have varying diameters may be utilized to in diameter as needed.

In addition to controlling the diameters of the first end 743 and the second end 745, the interface ring 742 may further be controlled by adjusting a height of the interface ring 742 as desired. The height of the interface ring 742 is the distance from the first end 743 to the second end 745. In various aspects, depending on the type, style, shape, etc. of the existing top cap, the height of the interface ring 742 can be controlled such that it is successively increased or decreased.

As illustrated in FIGS. 7-10, in addition to the top cap 740 and the interface ring 742, the top cap assembly 738 may include one or more gaskets 762. In the example of FIGS. 7-10, the top cap assembly 738 includes three gaskets 762A-C. In this example, the gasket 762A is at the end 744 to form a seal between the top cap 740 and the electronics housing 118, the gasket 762B is between the top cap 740 and the interface ring 742 to form a seal between the top cap 740 and the interface ring 742, and the gasket 762C is at the end 746 to form a seal between the interface ring 742 and the existing top cap. The number and/or location of the gaskets 762 should not be considered limiting on the current disclosure. For example, in embodiments where a plurality of interface rings are provided, a gasket may be provided between adjacent interface rings. In some examples, the top cap assembly 738 provides improved sealing and connection with existing top caps in the field because the top cap assembly 738 does not rely on existing gaskets or sealing devices of the existing top caps that were left in the field that may have degraded or otherwise become compromised over time. Instead, through the one or more gaskets 762, the top cap assembly 738 provides a reliable seal with the existing top cap in the field that ensures protection of the components of the light fixture and/or top cap assembly. Moreover, the top wall 751 on the top cap 740 ensures that the electronic components located within the electronics housing chamber 120 will always be protected, regardless of the condition of the existing top cap.

In certain examples, when the top cap assembly 738 is coupled with the electronics housing 118 of the light fixture 700, the top cap assembly 738 is movable relative to the electronics housing 118 such that the top cap 740 can selectively provide or prevent access to the electronics housing chamber 120. In various examples, when the top cap assembly 738 is engaged with the electronics housing 118, a seal is formed between the top cap 740 and the electronics housing 118 such that the electronics housing chamber 120 is sealed. In various cases, the electronics housing chamber 120 and top cap chamber 748 are jointly sealed together when the top cap assembly 738 is engaged with the electronics housing 118. In some cases, the sealing of the electronics housing chamber 120 may be accomplished during manufacture and prior to installation in the field. In other examples, such as when the top cap assembly 738 is a retrofit kit, the sealing may be accomplished in the field. Through the top cap assembly 738, the electronics housing chamber 120 can be effectively sealed from dirt, dust, moisture, etc., and the sealing of the electronics housing chamber 120 is not reliant on existing and/or degraded seals already in the field.

In various cases, the top cap assembly 738 renders the light fixture 700 compliant with the standards for the harsh and/or hazardous industrial applications. For example, through the top cap assembly 738, the light fixture 700 may be compliant with one or more of the standards UL-844 (for hazardous locations), UL-1598 (for safety luminaires), and/or NSF/ANSI 2-2015 (for food preparation applications), among other standards.

Figure 11:
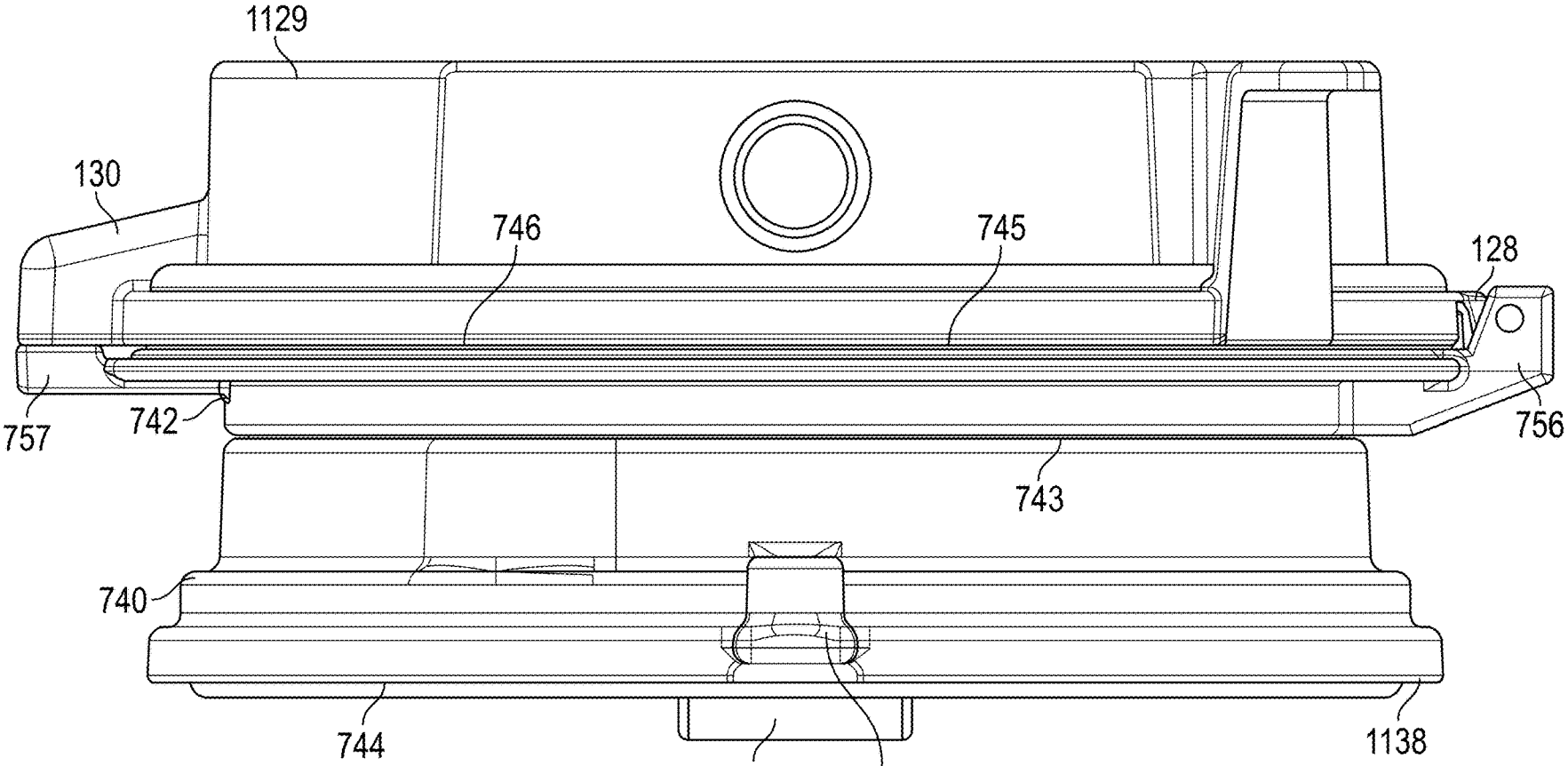
FIG. 11 is a side view of a retrofit top cap coupled to a top cap according to aspects of the current disclosure.

FIG. 11 illustrates an example of a top cap assembly 1138 coupled to a top cap 1129 that is different from the top cap 129. The top cap assembly 1138 is substantially similar to the top cap assembly 738 except that the diameter of the second end 745 of the interface ring 742 is greater than the diameter of the first end 743 of the interface ring 742. In this example, the top cap assembly 1138 can mate with an existing top cap having a greater diameter than the top cap 740.

Figure 12:
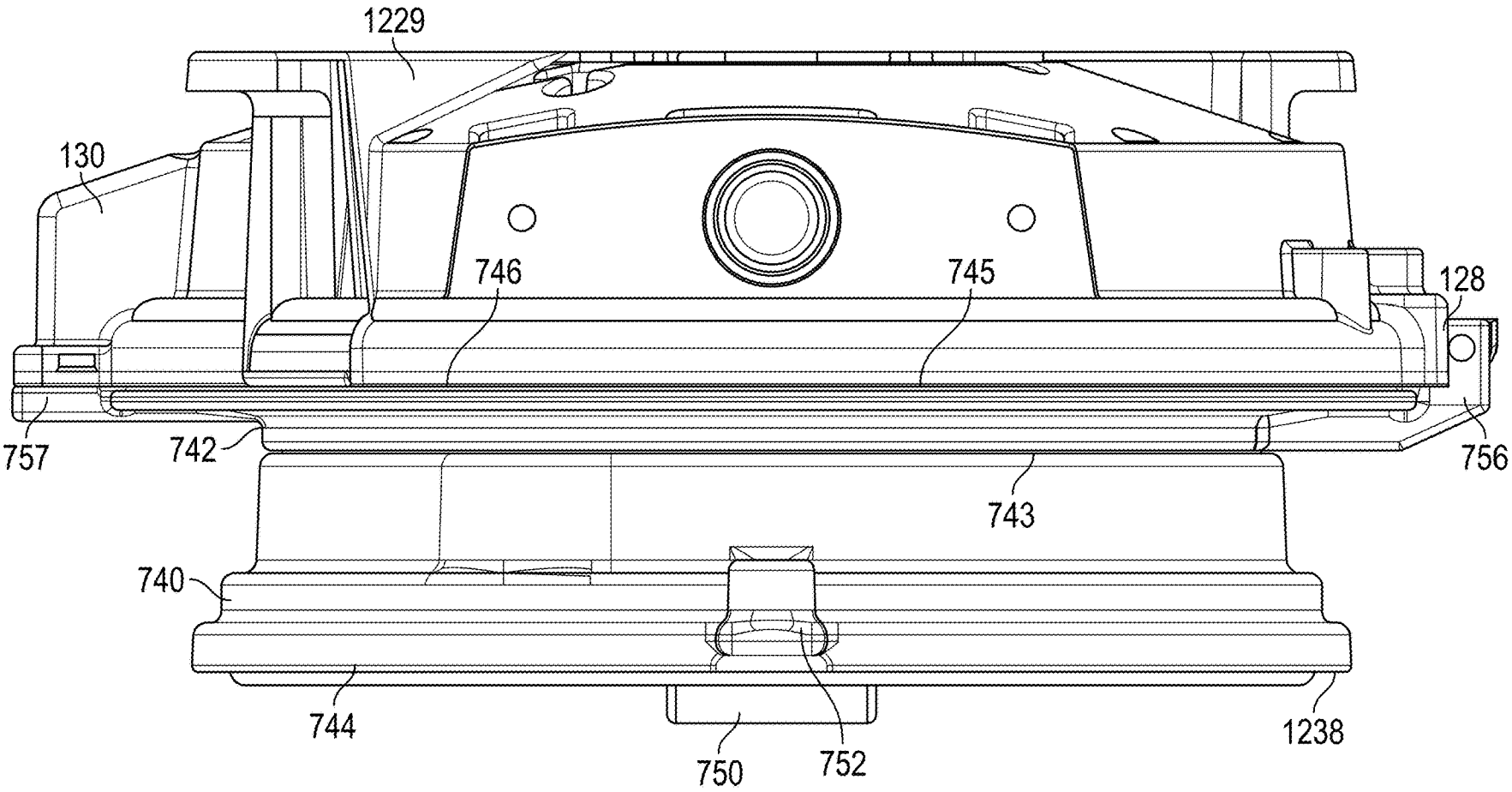
FIG. 12 is a side view of a retrofit top cap coupled to a top cap according to aspects of the current disclosure.

FIG. 12 illustrates an example of a top cap assembly 1238 coupled to a top cap 1229 that is different from the top cap 129 and different from the top cap 1129. The top cap assembly 1238 is substantially similar to the top cap assembly 738 except that the diameter of the second end 745 of the interface ring 742 of the top cap assembly 1238 is greater than the diameter of the second end 745 of the interface ring 742 of the top cap assembly 1138. In this example, the top cap assembly 1138 can mate with an existing top cap having a greater diameter than the top cap 740.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A light fixture comprising:

a fixture housing; and an optic coupled to the fixture housing, wherein the optic comprises silicone, wherein a diameter of the optic is at least 5 inches, and wherein the light fixture is compliant with standard UL-844 (Jun. 29, 2012), wherein the fixture housing comprises an electronics housing that defines an electronics housing chamber, wherein the light fixture further comprises a top cap assembly hingedly connected to the electronics housing, and wherein the top cap assembly comprises:

a top cap that selectively engages the electronics housing, wherein engagement of the top cap with the electronics housing seals the electronics housing chamber; and an interface ring that is configured to engage an existing top cap such that the light fixture is supported on the existing top cap.

2. The light fixture of claim 1, wherein the light fixture is compliant with standard NSF/ANSI 2-2015 (Dec. 11, 2015).

3. The light fixture of claim 1, wherein the light fixture is compliant with standard UL-1598 (Aug. 28, 2018).

4. The light fixture of claim 1, wherein the optic comprises a flange defining a perimeter edge of the optic, and wherein the optic is coupled to the fixture housing such that the optic forms a seal between the flange of the optic and the fixture housing.

5. The light fixture of claim 1, further comprising a securing ring that secures the optic against the fixture housing.

6. The light fixture of claim 1, further comprising a light source retained on the fixture housing, wherein the light source comprises a plurality of light emitting diodes, and wherein the optic is coupled to the fixture housing such that the optic covers the plurality of light emitting diodes.

7. A retrofit kit for an existing light fixture, the retrofit kit comprising a top cap assembly comprising:

a top cap defining a first end of the top cap assembly, wherein the top cap defines a top cap chamber having an top wall, and wherein the top cap is configured to selectively engage an electronics housing of the light fixture and seal an electronics housing chamber of the electronics housing; and an interface ring defining a second end of the top cap assembly opposite from the first end, wherein the interface ring is coupled to the top cap outside of the top cap chamber, and wherein the interface ring is configured to engage an existing top cap such that the light fixture is supported on the existing top cap.

8. The retrofit kit of claim 7, wherein an orientation of the interface ring relative to the top cap is adjustable such that an orientation of the light fixture relative to the existing top cap is adjustable.

9. The retrofit kit of claim 7, wherein the top cap comprises a top cap gasket, and wherein the interface ring comprises an interface ring gasket.

10. The retrofit kit of claim 7, wherein the interface ring comprises a first end and a second end, wherein the second end of the interface ring is the second end of the top cap assembly, wherein the first end of the interface ring is adjacent to the top wall of the top cap, and wherein a diameter of the second end of the interface ring is different from a diameter of the first end of the interface ring.

11. The retrofit kit of claim 7, wherein the top cap comprises a first attachment component and the interface ring comprises a second attachment component, wherein the retrofit kit is configured to hingedly couple with the electronics housing through the first attachment component, and wherein the retrofit kit is configured to hingedly couple with the existing top cap through the second attachment component.

12. The retrofit kit of claim 7, wherein the top cap and interface ring are monolithically formed as an integral unit.

13. A light fixture comprising:

a fixture housing comprising an electronics housing, wherein the electronics housing defines an electronics housing chamber; and a top cap assembly coupled to the electronics housing, wherein the top cap assembly comprises:

a top cap defining a first end of the top cap assembly, wherein the top cap selectively engages the electronics housing and seals the electronics housing chamber; and an interface ring defining a second end of the top cap assembly opposite from the first end, wherein the interface ring is configured to engage an existing top cap such that the light fixture is supported on the existing top cap.

14. The light fixture of claim 13, wherein an orientation of the interface ring relative to the top cap is adjustable such that an orientation of the light fixture relative to the existing top cap is adjustable.

15. The light fixture of claim 13, wherein the top cap comprises a top cap gasket that is configured to form a seal between the top cap and the electronics housing, and wherein the interface ring comprises an interface ring gasket that is configured to form a seal with the existing top cap.

16. The light fixture of claim 13, wherein the top cap comprises a first attachment component and the interface ring comprises a second attachment component, wherein the top cap assembly is hingedly coupled to the electronics housing through the first attachment component, and wherein the top cap assembly is configured to hingedly couple with the existing top cap through the second attachment component.

17. The light fixture of claim 13, wherein the light fixture is compliant with standard UL-1598 (Aug. 28, 2018).

18. The light fixture of claim 13, further comprising an optic, wherein the fixture housing further comprises a heatsink and a light source retained on the fixture housing, wherein the light source comprises a plurality of light emitting diodes, and wherein the optic is coupled to the fixture housing such that the optic covers the plurality of light emitting diodes.

19. The light fixture of claim 18, wherein the optic comprises silicone, and wherein the light fixture is compliant with at least one of standard UL-844 (Jun. 29, 2012) or standard NSF/ANSI 2-2015 (Dec. 11, 2015).

* * * * *